US007240698B2

(12) United States Patent
Debaes

(10) Patent No.: US 7,240,698 B2
(45) Date of Patent: Jul. 10, 2007

(54) METHOD FOR WEAVING FACE-TO-FACE FABRICS, FABRIC WOVEN ACCORDING TO SUCH A METHOD AND FACE-TO-FACE WEAVING MACHINE FOR CARRYING OUT SUCH A METHOD

(75) Inventor: Johny Debaes, Moorslede (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 34 days.

(21) Appl. No.: 11/290,615

(22) Filed: Nov. 30, 2005

(65) Prior Publication Data

US 2006/0118196 A1 Jun. 8, 2006

(30) Foreign Application Priority Data

Dec. 2, 2004 (BE) ..... 2004/0589

(51) Int. Cl.

| | |
|---|---|
| ***D03J 1/13*** | (2006.01) |
| ***D03D 39/16*** | (2006.01) |
| *D03D 49/62* | (2006.01) |
| *D03D 49/68* | (2006.01) |

(52) U.S. Cl. ..... 139/37; 139/98; 139/102; 139/188 R; 139/192

(58) Field of Classification Search ..... 139/1 R, 139/18, 21, 37, 98, 102, 188 R, 192
See application file for complete search history.

(56) References Cited

U.S. PATENT DOCUMENTS

| | | | | |
|---|---|---|---|---|
| 1,691,194 | A | 11/1928 | Howard | |
| 5,154,208 | A | 10/1992 | Derudder | |
| 6,817,383 | B2 * | 11/2004 | Debaes et al. | 139/21 |
| 6,837,274 | B2 * | 1/2005 | Debaes et al. | 139/21 |
| 7,086,424 | B2 * | 8/2006 | Debaes et al. | 139/418 |
| 7,111,647 | B2 * | 9/2006 | Debaes | 139/21 |
| 7,117,897 | B2 * | 10/2006 | Debaes | 139/21 |
| 7,134,401 | B2 * | 11/2006 | Debaes et al. | 116/21 |
| 2003/0226613 | A1 * | 12/2003 | Debaes et al. | 139/408 |
| 2004/0221910 | A1 * | 11/2004 | Debaes | 139/11 |
| 2004/0221915 | A1 * | 11/2004 | Debaes et al. | 139/409 |
| 2005/0109416 | A1 * | 5/2005 | Debaes et al. | 139/37 |
| 2005/0183787 | A1 * | 8/2005 | Debaes et al. | 139/11 |
| 2005/0247367 | A1 * | 11/2005 | Debaes et al. | 139/327 |
| 2007/0006932 | A1 * | 1/2007 | Mertens et al. | 139/37 |

* cited by examiner

*Primary Examiner*—Robert H Muromoto
(74) *Attorney, Agent, or Firm*—James Creighton Wray

(57) ABSTRACT

On the one hand, the invention relates to a method for weaving face-to-face fabrics on a face-to-face weaving machine, the fabrics (10),(20) consisting of weft yarns (2), ground warp yarns (3) and pile warp yarns (4), and one or several spacers (1) being provided in order to keep the fabrics (10),(20) at a distance during the weaving process, and a weaving reed being provided, comprising reed dents (A),(B),(C) through which the said ground warp yarns (3) and pile warp yarns (4) are extending, and through which the spacers (1) are extending every two or more reed dents (A),(B),(C), wherein the pile warp yarns (4) and the spacers (1) are separated from one another in the respective reed dents (A),(B),(C). On the other hand, the invention relates to a fabric woven in accordance with such a method and a face-to-face weaving machine designed to carry out such a method.

8 Claims, 6 Drawing Sheets

METHOD FOR WEAVING FACE-TO-FACE FABRICS, FABRIC WOVEN ACCORDING TO SUCH A METHOD AND FACE-TO-FACE WEAVING MACHINE FOR CARRYING OUT SUCH A METHOD

This application claims the benefit of Belgian Application No. 2004/0589 filed Dec. 2, 2004, which is hereby incorporated by reference in its entirety.

BACKGROUND OF THE INVENTION

On the one hand, the invention relates to a method for weaving face-to-face fabrics on a face-to-face weaving machine, the fabrics consisting of weft yarns, ground warp yarns and pile warp yarns, and one or several spacers being provided in order to keep the fabrics at a distance from one another during the weaving process, and a weaving reed being provided comprising reed dents, through which the said ground warp yarns and pile warp yarns are extending, and through which the spacers are extending every two or more reed dents.

Furthermore, the invention relates to a fabric, consisting of weft yarns, ground warp yarns and pile warp yarns and to a face-to-face weaving machine for weaving face-to-face fabrics consisting of weft yarns, ground warp yarns and pile warp yarns.

More specifically, the invention relates to a method for weaving shaggy fabrics.

Shaggy, fabrics, likewise called shag fabrics, are fabrics in which long coarse pile warp yarns are used. The pile height ranges from 15 mm to 100 mm. The thickness of the yarns is starting from 3000 denier and may reach 12000 deniers and even 30000 denier. Sometimes, for such shaggy fabrics, also yarns are used in which a thick and a thin yarn are united to form one single yarn in order to create additional effects, Today, shaggy fabrics are mainly made of wool, hand-tufted or woven on single fabric weaving machines such as rod weaving machines or Axminster weaving machines. Such fabrics, however, are not suitable for being produced on a face-to-face weaving machine, as it is not always possible to interweave the thick pile warp yarns in the usual 2-and 3-shot weave as it is difficult to conceal the thick pile warp yarns in the fabric and as in fabrics made with a longer pile height (over 30 mm) there is the disadvantage that the pile retention leaves much to be desired and the quantity of yarn to be supplied, within one operating cycle of the machine, by the bobbin on the weaving rack will become too large because of the pile moving from the upper to the lower fabric. Moreover, the disadvantage mentioned last will cause a heavy load on the Jacquard machine, depending on the pattern to be woven.

In a single fabric rod weaving machine, these problems are less frequent, as the quantity of pile warp yarns that have to be supplied within one machine cycle is more limited, because only one fabric is woven and, moreover, the speed of the machine is lower. Also, when weaving on an Axminster weaving machine, these problems are less frequent, as the pile warp yarn have to be supplied for only one fabric, the weaving speed is lower and only one pile is inserted every three wefts. Furthermore, there are no problems either, caused by a dead pile.

Both single fabric rod weaving and Axminster weaving, however, have a significantly lower weaving efficiency than face-to-face weaving. Moreover, with none of these techniques it will be possible at the present time to produce shaggy or tufted fabrics by means of the cheaper yarns made of synthetic material or polypropylene.

To a man skilled in the art, it is not obvious to weave the thick yarns made of wool or polypropylene in several colors or with a long pile when making use of a face-to-face weaving technique. When using a Jacquard-weaving method with several colors and/or effects on a face-to-face weaving machine, each warp yarn system will comprise the various pile warp yarns having the various colors or effects, together with the ground warp yarns used to form the backing fabrics. In order to keep the upper and the lower fabric at a certain distance from one another, in face-to-face double-rapier weaving, spacers are used, likewise called lancets.

In most cases the number of warp yarn systems is corresponding with the number of reed dents of the weaving reed and each dent in the weaving reed comprises the said backing and pile warp yarns, as well as the spacer. In the event of shaggy fabrics, in which thicker yarns are used, the problem is that, within the reed dent, the thicker pile warp yarns will collide, mutually as well as with the ground warp yarns and with the spacer, when they have to take up their positions to form the shed desired in accordance with the pattern to be formed. This may cause several yarns to become entangled or warp yarns and spacers to get stuck in the reed dent. It may be possible to limit this risk by using a lower density of the reed, to reduce the number of reed dents, or using less colors or yarns that are less thick.

It is already known not to use the spacer in each warp yarn system or in each reed dent. Thus it will be possible to reduce the risk because the problem may occur only in part of the warp yarn systems, but the problem still exists and may still occur.

SUMMARY OF THE INVENTION

On the one hand, the purpose of the invention is to provide a method for weaving face-to-face fabrics on a face-to-face weaving machine, the fabrics consisting of weft yarns, ground warp yarns and pile warp yarns, and one or several spacers being provided in order to keep the fabrics at a distance during the weaving process, and a weaving reed being provided, comprising reed dents through which the said ground warp yarns and pile warp yarns are extending, and through which the spacers are extending every two or more reed dents, wherein an equal pile height is maintained, and wherein the two fabrics, both at the back and on the pile face are aesthetically attractive.

This purpose according to the invention is attained by providing a method having the characteristics indicated in the first paragraph of this description, wherein the pile warp yarns and the spacers are separated from one another in the respective reed dents.

In this manner, it will nevertheless be possible to maintain a sufficient distance between the upper and the lower fabric, while there will be no interference problems in a reed dent between the various pile warp yarns and the spacers. In this manner, fabrics may be woven with more colors or thicker yarns may be used because of the absence of spacers between the pile warp yarns.

This means that in the pattern at the back of the fabric in the direction of the warp, lines will be found, where no pile is interlaced, because in these warp systems only a spacer with possible ground warp yarns will be found, but no pile warp yarn. However, on the pile face of the fabric, because of the height of the pile and the thickness of the yarns this irregular distribution of the pile in the weft direction will not be noticed.

Yet, in order to be able to reduce this effect of an irregular distribution of the pile in the weft direction, a smaller width may be provided for the reed dent in which a spacer extends than for the reed dent in which the pile and ground warp yarns are extending.

This has the advantage that the pattern at the back of the fabric will become aesthetically more attractive and that the effect of an irregular distribution on the pile face of the fabric will be still further reduced.

In a preferred embodiment of a method according to the invention, between each couple of reed dents with spacers at least two reed dents are provided with pile and ground warp yarns.

In a still more preferred embodiment according to the invention, the warp yarns are arranged in adjacent reed dents such that:

the pile warp yarns of a second reed dent are immediately fitting a first reed dent in which a spacer is provided;

the ground warp yarns of the second reed dent are arranged on the side of a third reed dent, situated on the opposite side of the first reed dent with respect to the second reed dent;

the ground warp yarns of the third reed dents are arranged on the side of the second reed dent.

the pile warp yarns of the third reed dent are disposed on the side opposite the side adjacent to the second reed dent.

In this manner, the effect of an irregular distribution of the pile in the weft direction is still further reduced.

In an advantageous embodiment of a method according to the invention, in each reed dent of the weaving reed ground warp yarns are extending.

The fabrics preferably woven by means of this method are shaggy fabrics.

Another purpose of the invention is to provide a fabric consisting of weft yarns, ground warp yarns and pile warp yarns having an equally long pile height and moreover, are aesthetically attractive both at the back and on the pile face.

This purpose of the invention is attained by providing a fabric consisting of weft yarns, ground warp yarns and pile warp yarns, the fabric being woven by means of a method according to the invention as described above.

A last purpose of the invention is to provide a face-to-face weaving machine for weaving face-to-face fabrics consisting of weft yarns, ground warp yarns and pile warp yarns, the face-to-face weaving machine being provided for weaving fabrics having an equally long pile height and being aesthetically attractive both at the back and on the pile face.

This purpose of the invention is attained by providing a face-to-face weaving machine for weaving face-to-face fabrics consisting of weft yarns, ground warp yarns and pile warp yarns, the face-to-face weaving machine being provided to carry out a method according to the invention as described above.

In the following detailed description, the above-mentioned characteristics and advantages of a method for weaving fabrics according to the invention will be further clarified. This description is only intended to clarify the general principle of the present invention, therefore nothing in this description may be interpreted as a restriction of the field of application of the invention and of the patent rights demanded for in the claims.

In this description reference is made, by means of reference numbers, to the attached FIGS. 1 up to and including 4, in which:

DETAILED DESCRIPTION OF THE PREFERRED EMBODIMENTS

Figure 1:
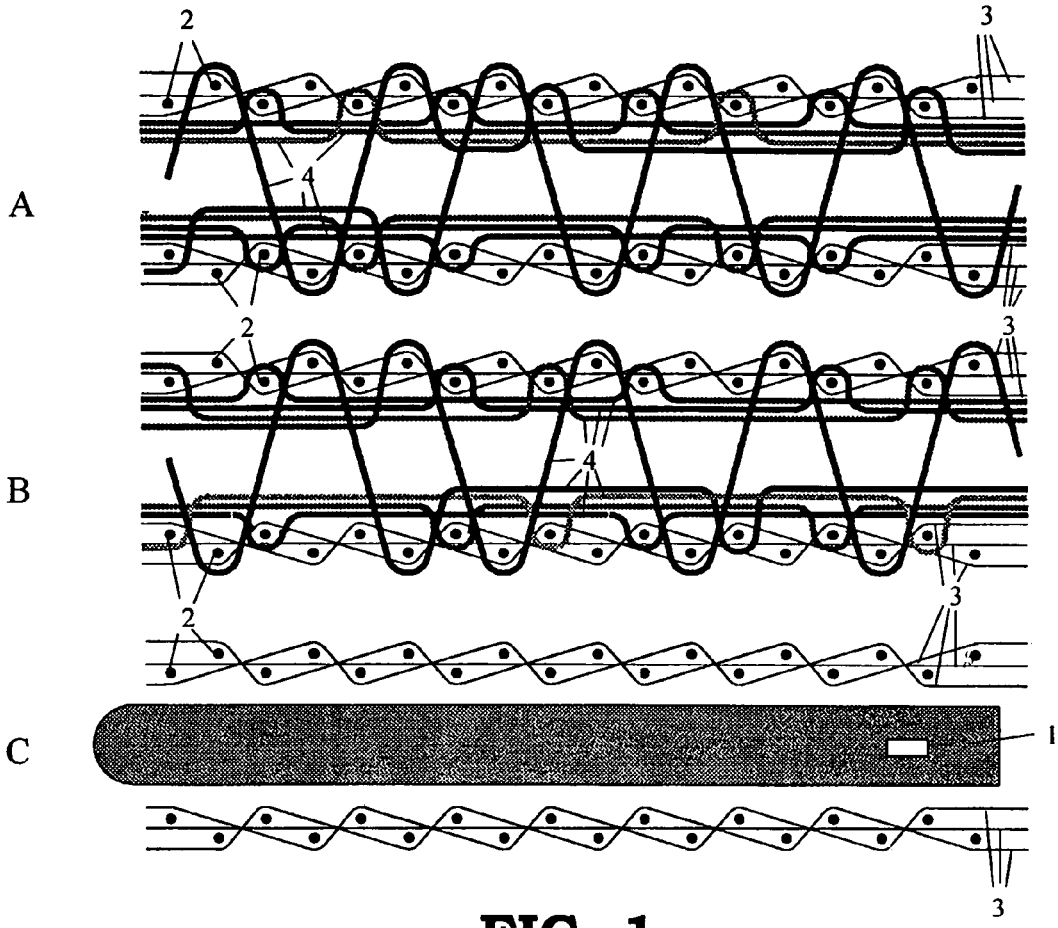
FIG. 1 is representing a schematic cross-section of fabrics, woven according to a ¼ V-weave, in which a spacer is extending each three reed dents, backing and pile warp being there in the first two reed dents, and a spacer and ground warp yarns being there in the third reed dent.
Figure 2:
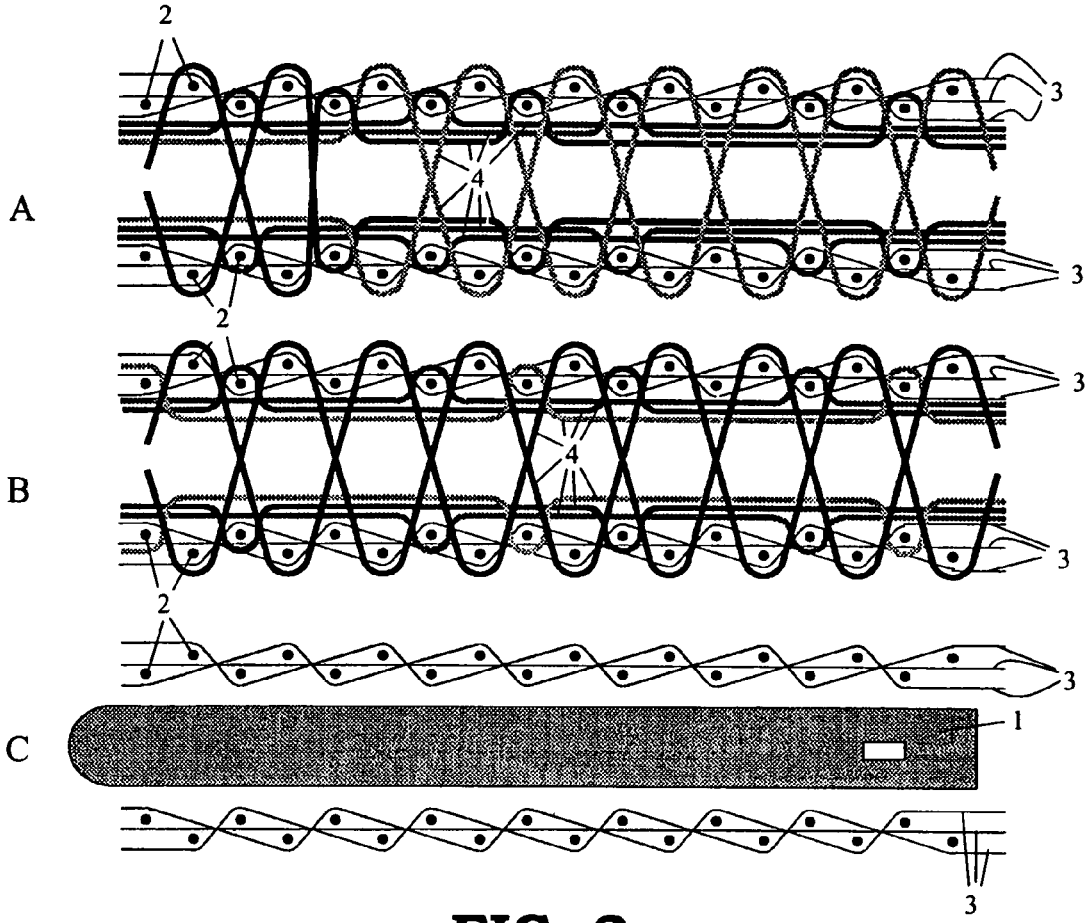
FIG. 2 is representing a schematic cross-section of fabrics, woven according to a ¼ V-weave in opposite phase, in which every three reed dents a spacer is extending, backing and pile warp yarns being there in the first two reed dents, and a spacer and ground warp yarns being there in the third reed dent.

The method according to the invention for weaving face-to-face fabrics is carried out on a face-to-face weaving machine. A fabric (10), (20) (see FIGS. 1 up to and including 4) is consisting of weft yarns (2), ground warp yarns (3) (=backing warp yarns) and pile warp yarns (4). Furthermore one or several spacers (1) are provided in order to keep the fabrics (10), (20) at a distance from one another. Furthermore, the face-to-face weaving machine is provided with a weaving reed, comprising one or more reed dents (A), (B), (C), through which the said ground warp yarns (3) and pile warp yarns (4) on the one hand, and spacers (1) possibly together with ground warp yarns (3) on the other hand, are extending. Every two or more reed dents (A), (B), (C), the spacers (1) extend through the weaving reed. As represented in the FIGS. 1 and 2, in a preferred embodiment, every three reed dents a spacer (1) is extending in a reed dent (C), while in this reed dent (C) only ground warp yarns (3) are extending and no pile warp yarns (4). In the two adjacent reed dents (A), (B), pile warp and ground warp yarns (3), (4) do extend, but there are no spacers (1). However, this does not mean that there are no other embodiments where a spacer (1) is used every 2, 4, 5 or more reed dents. Furthermore, the number of warp yarn systems between two successive reed dents (A), (B), (C) where there is a spacer (1) without pile warp yarns (4) is different across the width of the fabric (10), (20), for instance, alternating every three and every four reed dents (A), (B), (C).

By providing a spacer (1) every two or more reed dents without pile warp yarns (4) and a spacer (1) appearing together in the same reed dent, it will be possible, as already mentioned above, to maintain a sufficient distance between the fabrics (10),(20), without any interference problems occurring between the various pile warp yarns (4) in a reed dent and the spacer (1), and consequently fabrics (10),(20)

can be woven having more colors or thicker yarns because of the absence of a spacer (1) between the pile warp yarns (4).

Consequently, in the pattern at the back of the fabric (10),(20) lines will be found in the warp direction where no pile is interlaced, because in these warp yarn systems only a spacer (1), possibly with ground warp yarns (3), will occur, but no pile warp yarns (4) will be found. On the pile face of the fabric (10),(20), however, the height of the pile and the thickness of the yarns will prevent that this irregular distribution of the pile in the weft direction will be noticed.

In order to reduce this effect of an irregular distribution of the pile in the weft direction, the disposition of the pile warp yarns (2),(3),(4) in reed dents (A),(B),(C) situated next to one another, may be adapted.

Figures 1, 3:
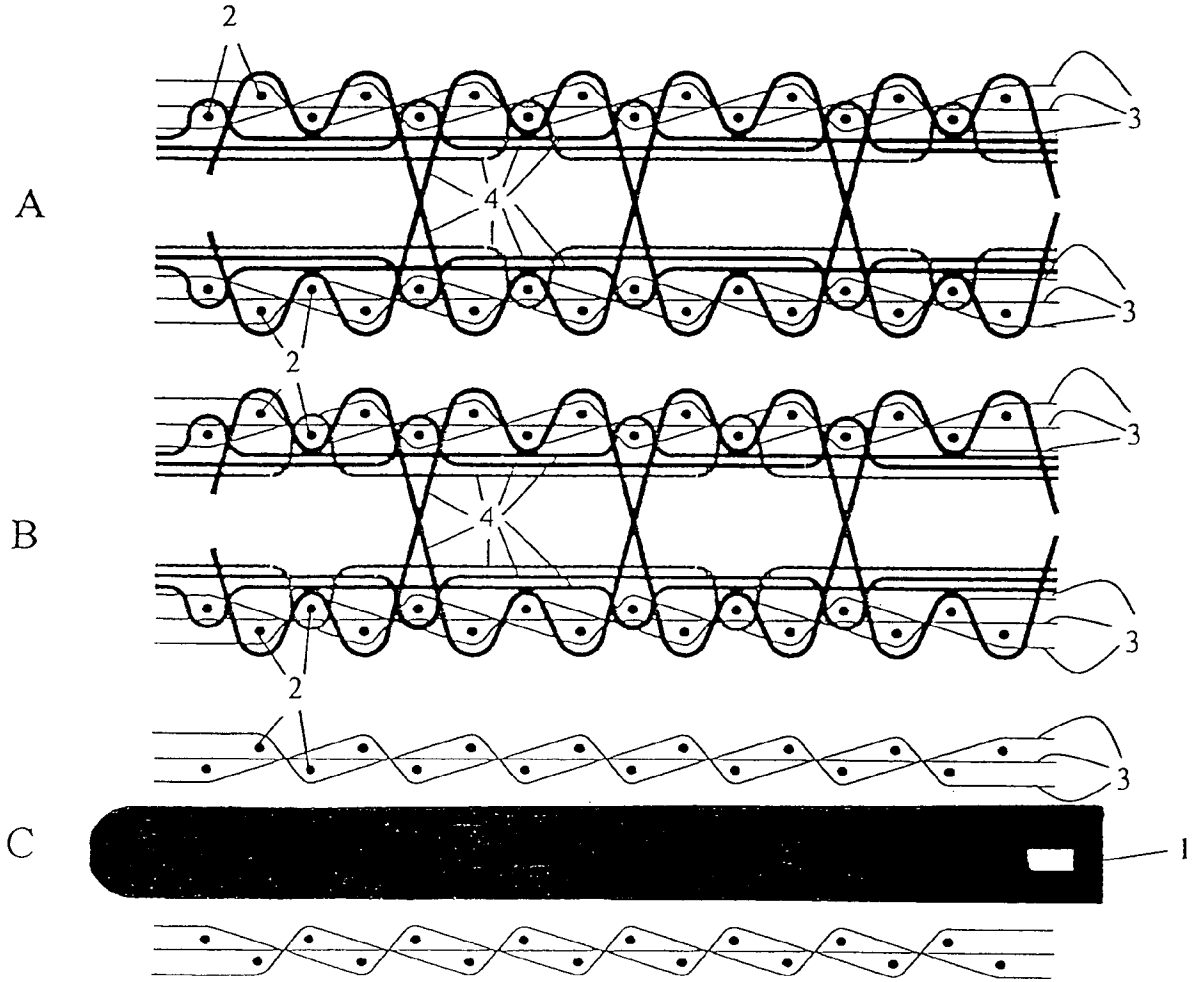
FIG. 3 is representing a schematic cross-section of fabrics, woven according to a ⅜ W-weave and the corresponding heddling, a spacer extending every three reed dents, backing and pile warp yarns being there in the first and second reed dent, and a spacer and ground warp yarns being there in the third reed dent.
Figures 2, 3:
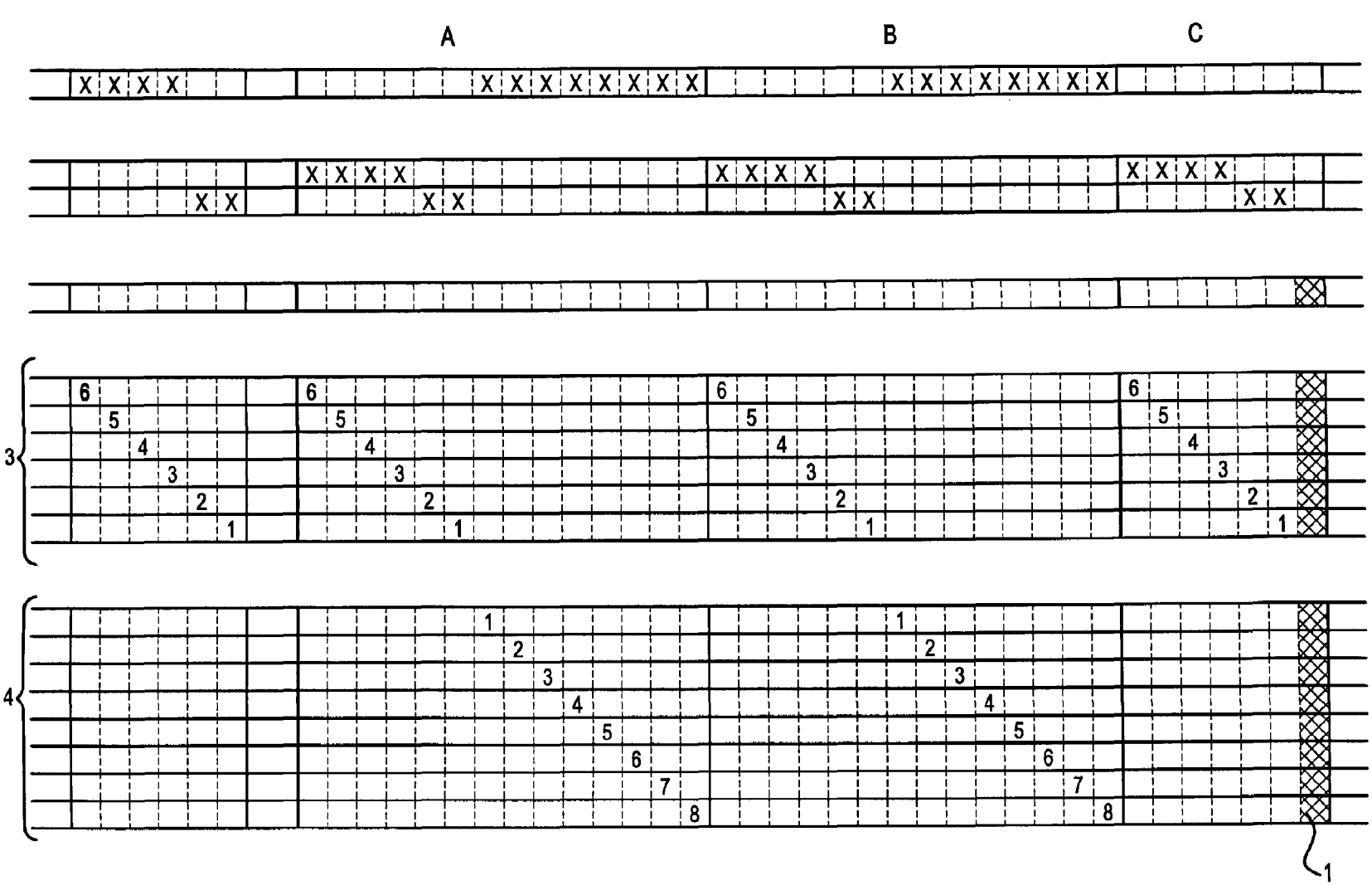

In FIG. 3, a heddling for a face-to-face weaving machine is represented, where every three reed dents (A),(B),(C), a spacer (1) is extending through a reed dent (C). With this heddling, in a first reed dent (A), and in a second reed dent (B), from left to right, there are first of all the ground warp yarns (3) and next to them, the pile warp yarns (4). In the third reed tooth (C) there are, from left to right, first of all the ground warp yarns (3) and then there is a spacer (1). The subsequent first reed dent (not represented in the figure) starts again with ground warp yarns (3).

In this manner, at the back of the fabric (10),(20) it will be noted that, in the third dent, the ground warp yarns (4), across the full width of the fabric (10),(20), are not situated nicely right in the middle between the warp yarn system extending through the second reed dent (B), and the warp yarn system extending through the fourth reed dent which is built up like the first reed dent (A). Within the third reed dent (C), the ground warp yarns (3) are free to float across the width of the reed dent (C), because there is a large space available within this reed dent (C). This will enable the pile warp yarns (4) of the second reed dent (B) to be floating along towards the ground warp yarns (3) of the third reed dent (C) up to the line where the ground warp yarns (3) of the third reed dent (C) are tightly interlaced. The ground warp yarns (3) of the fourth reed dent, however, will maintain their position very well and will continue to form a straight line very well, because they are maintained in position by the lamella of the weaving reed between the third reed dent (C) and the fourth reed dent, and are tightly interlaced in that position. The ground warp yarns (3), being tightly interlaced and maintained in position, prevent the pile warp yarns from having any space whatsoever in the fourth reed dent to float. In order to enable these pile warp yarns (4) to have indeed a possibility to float, the ground warp yarns (3) of the fourth reed dent should not be allowed to get between the pile warp yarns (4) and the ground warp yarns (3) of the third reed dent. The pile warp yarns (4) in the second reed dent (B) which are interlaced less tightly than the ground warp yarns (3) do have space to extend to the ground warp yarns (3) of the third reed dent (C), because there are no ground warp yarns (3) tightly interlaced in the second reed dent (B) between the pile warp yarns (4) in the second reed dent (B) and the ground warp yarns (3) in the third reed dent.

As described above, the same possibility for the pile warp yarns (4) of the fourth reed dent to float freely, is also attained by making the pile warp yarns (4) in the first (A), the fourth, the seventh and the other reed dents immediately fit the third (C), the sixth, the ninth and the other reed dent, a spacer (1) being found in each of these reed dents. The ground warp yarns (3) of the first (A), the fourth, the seventh and the other reed teeth are arranged on the side of the second (B), the fifth, the eighth and the other reed dents. In this manner, the ground warp yarns (3) are situated in the first (A), the fourth, the seventh and the other reed dents and the ground warp yarns (3) of the second (B), the fifth, the eighth and the other reed dents directly next to one another, because of which the pile warp yarns (4) of both these series of reed dents will be able to float a bit further away from one another, towards the ground warp yarns (3) in the third reed dent (C) or, in case there is no backing warp yarn (3) to be found in the third reed dents, towards one another. Consequently, a more regular spreading is obtained in combination with the third (C), the sixth, the ninth and the other reed dents, where only a spacer (1) and/or ground warp yarns (3) are extending. As in this manner both the pile warp yarns (4) of the first (A), the fourth, the seventh and the other reed dents and of the second (B), the fifth, the eighth and the other reed dents may float along with the floating ground warp yarns (3) of the third (C), the sixth, the ninth and the other reed dents, this floating will additionally improve the regularity of the pile distribution in the weft direction when the present invention is applied.

Figures 1, 4:
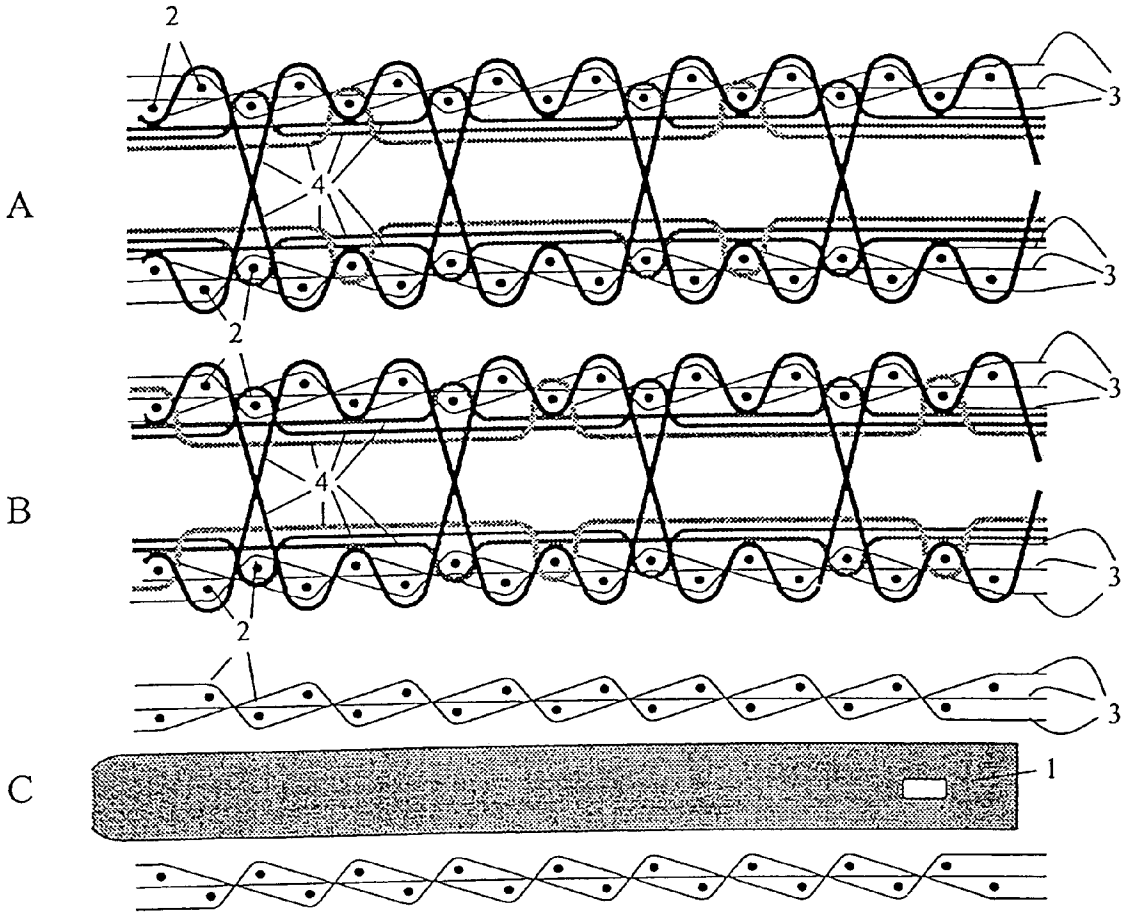
FIG. 4 is representing a schematic cross-section of fabrics, woven according to a ⅜ W-weave and the corresponding heddling, a spacer extending every three reed dents, backing and pile warp yarns being there in the first and second reed dent, and a spacer and ground warp yarns being there in the third reed dent, and the disposition of the warp yarns in reed dent situated next to one another being adapted.
Figures 2, 4:
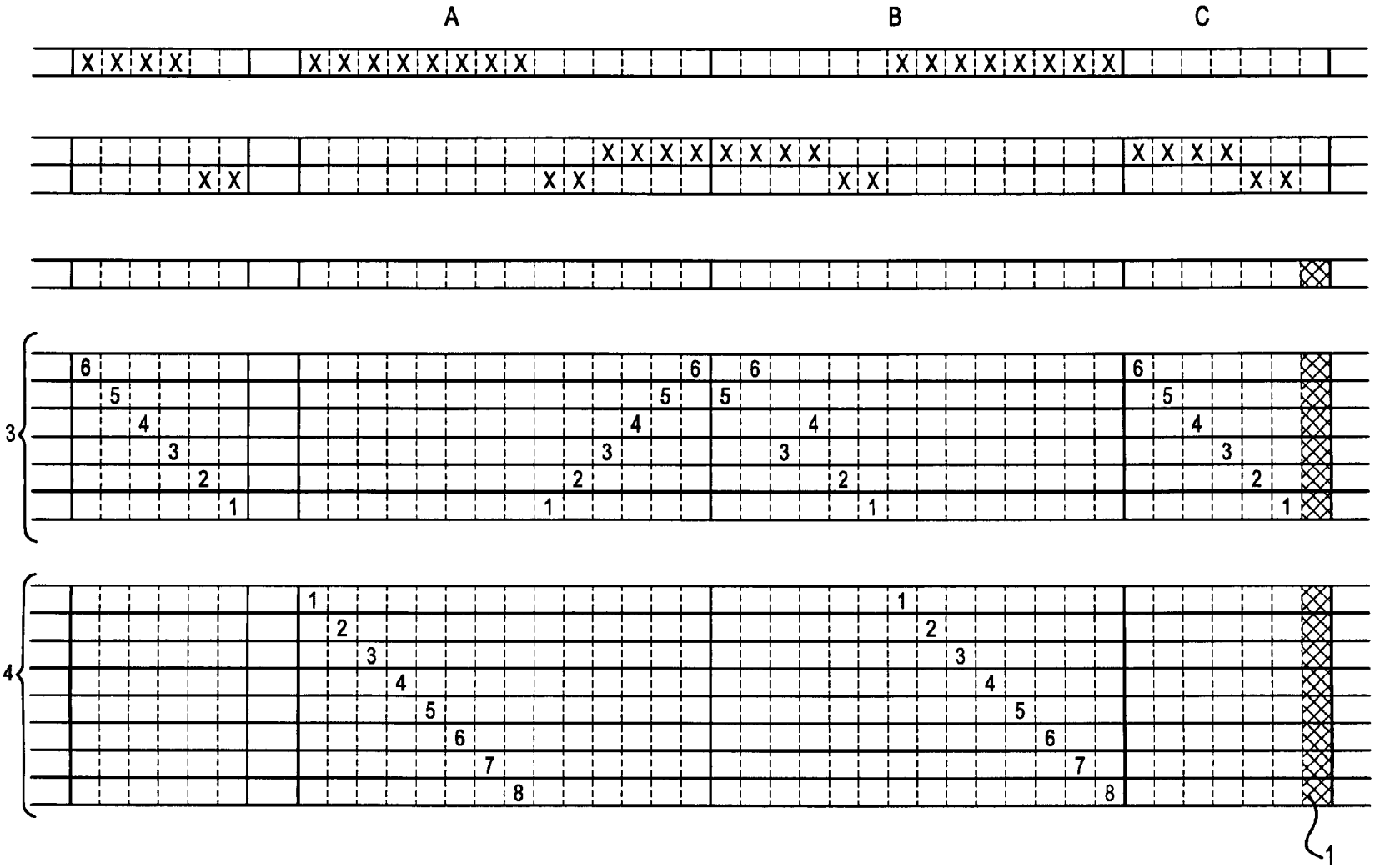

In FIG. 4, such a heddling for a face-to-face weaving machine is represented, every three reed dents (A),(B),(C) a spacer (1) being installed with only ground warp yarns (3) and the disposition of the pile warp yarns (3),(4) in reed dents (A),(B),(C) being situated next to one another being adapted. Moreover, the warp yarns (3),(4) in reed dents (A),(B),(C) situated next to one another are disposed such that:

- the pile warp yarns (4) of a second reed dent (B) are directly fitting a first reed dent (A) in which a spacer (1) is arranged;
- the ground warp yarns (3) of the second reed dent (B) are arranged on the side of a third reed dent (C) which is situated on the opposite side of the first reed dent (A) with respect to the second reed dent (B);
- the ground warp yarns (3) of the third reed dent (C) are arranged on the side of the second reed dent (B);
- the pile warp yarns (4) of the third reed dent (C) are arranged on the side opposite to the side adjacent to the second reed dent (B).

The invention claimed is:

1. Method for weaving face-to-face fabrics on a face-to-face weaving machine, the fabrics (10),(20) consisting of weft yarns (2), ground warp yarns (3) and pile warp yarns (4), and one or several spacers (1) being provided in order to keep the fabrics (10),(20) at a distance during the weaving process, and a weaving reed being provided, comprising reed dents (A),(B),(C) through which the said ground warp yarns (3) and pile warp yarns (4) are extending, and through which the spacers (1) are extending every two or more reed dents (A),(B),(C), characterized in that the pile warp yarns (4) and the spacers (1) are separated from one another in the respective reed dents (A), (B), (C).

2. Method according to claim 1, characterized in that the reed dents (C) in which a spacer (1) is extending, have a smaller width than the reed dents (A),(B) in which pile and ground warp yarns (3),(4) are extending.

3. Method according to claim 1, characterized in that between each couple of reed dents (C) with spacers (1) at least two reed dents (A),(B) are provided with pile and ground warp yarns (3),(4).

4. Method according to claim 1, characterized in that the warp yarns (3),(4) are arranged in adjacent reed dents (A),(B),(C) such that:

the pile warp yarns (4) of a second reed dent (B) are immediately fitting a first reed dent (A) in which a spacer (1) is provided, the ground warp yarns (3) of the second reed dent (B) are arranged on the side of a third reed dent (C), situated on the opposite side of a first reed dent (A) with respect to the second reed dent (B);

the ground warp yarns (3) of the third reed dent (C) are arranged on the side of the second reed dent (B);

the pile warp yarns (4) of the third reed dent (C) are arranged on the side opposite to the side adjacent to the second reed dent (B).

5. Method according to claim 1, characterized in that in each reed dent (A),(B),(C) of the weaving reed ground warp yarns (3) are extending.

6. Method according to claim 1, characterized in that the fabrics are shaggy fabrics.

7. Fabric consisting of weft yarns (2), ground warp yarns (3) and pile warp yarns (4), characterized in that the fabric is woven according to claim 1.

8. Face-to-face weaving machine for weaving face-to-face fabrics consisting of weft yarns (2), ground warp yarns (3) and pile warp yarns (4), characterized in that the face-to-face weaving machine is provided to carry out a method according to claim 1.

* * * * *